US008630570B2

(12) United States Patent
Kouzu

(10) Patent No.: US 8,630,570 B2
(45) Date of Patent: Jan. 14, 2014

(54) TRANSFER DEVICE, IMAGE FORMING APPARATUS, AND IMAGE FORMING METHOD

(75) Inventor: Norio Kouzu, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 341 days.

(21) Appl. No.: 13/045,330

(22) Filed: Mar. 10, 2011

(65) Prior Publication Data

US 2011/0262191 A1 Oct. 27, 2011

Related U.S. Application Data

(60) Provisional application No. 61/326,537, filed on Apr. 21, 2010.

(51) Int. Cl.
*G03G 15/20* (2006.01)

(52) U.S. Cl.
USPC ..... 399/313; 399/124; 399/388; 399/195

(58) Field of Classification Search
USPC ..... 399/313, 124, 367, 388, 195
See application file for complete search history.

(56) References Cited

U.S. PATENT DOCUMENTS

2004/0175210 A1* 9/2004 Otaka ..... 399/318
2008/0159784 A1* 7/2008 Seto ..... 399/167
2010/0303519 A1 12/2010 Okaji

* cited by examiner

*Primary Examiner* — Walter L Lindsay, Jr.
*Assistant Examiner* — Roy Y Yi
(74) *Attorney, Agent, or Firm* — Patterson & Sheridan L.L.P.

(57) ABSTRACT

A transfer device includes a transfer roller, a first resilient member configured to urge the transfer roller in the direction toward a recording medium carrying path, a pair of sliding members configured to support both ends of the transfer roller independently from each other, a pair of transfer roller holding members configured to support the respective sliding members so as to be capable of sliding and rotate about a center of rotation independently from each other, and a carrying guide configured to rotate about the center of rotation, be urged in the direction toward the transfer roller holding members by a second resilient member, and be restricted from rotating by the sliding members.

19 Claims, 5 Drawing Sheets

TRANSFER DEVICE, IMAGE FORMING APPARATUS, AND IMAGE FORMING METHOD

CROSS-REFERENCE TO RELATED APPLICATIONS

This application is based upon and claims the benefit of priority from the prior the U.S. Patent Application No. 61/326,537, filed on Apr. 21, 2010, and the entire contents of which are incorporated herein by reference.

FIELD

The present embodiments relate to a transfer device, an image forming apparatus, and an image forming method.

BACKGROUND

An electronic image forming apparatus such as a copying machine or a printer forms an image by transferring a developer image from a transfer belt or a photoconductive drum to a recording medium using a transfer device, and fixing the transferred developer image onto the recording medium.

The transfer device includes a transfer roller, and transfers the developer image to the recording medium by applying voltage to the transfer roller and pressurizing the same. The recording medium having the developer image transferred thereto is carried to a fixing device along a carrying guide.

Therefore, positioning of the transfer roller and positioning of the carrying guide downstream of the transfer roller in the recording medium carrying direction are required for achieving satisfactory transfer and avoiding paper jam.

The transfer roller and the carrying guide in the related art are mounted to an integrally formed holding member. The transfer roller is covered on its surface with a resilient member, and hence precision of external dimensions is not high.

Therefore, it is necessary to intensify load application to the transfer roller by a spring in the direction toward a transfer opposing roller or the photoconductive drum considering tolerances of external dimensions of the transfer roller. The holding member configured to hold the transfer roller is required to have a strength which can resist the load application. Therefore, increases in weight and manufacture cost are resulted.

With this regards, as a method of reducing the load application to the holding member, a method of holding both ends of the transfer roller by independently displaceable members is proposed.

However, the carrying guide cannot follow the movement of the holding member because the movement of the holding member is provided with flexibility. Therefore, a gap is formed due to a change in relative position with respect to the holding member, so that paper jam may occur because of entry of the recording medium into the gap.

Therefore, there is a demand for a transfer device, an image forming apparatus, and an image forming method in which positioning of the transfer roller and the carrying guide with high degree of accuracy is ensured.

DETAILED DESCRIPTION

Figure 1:
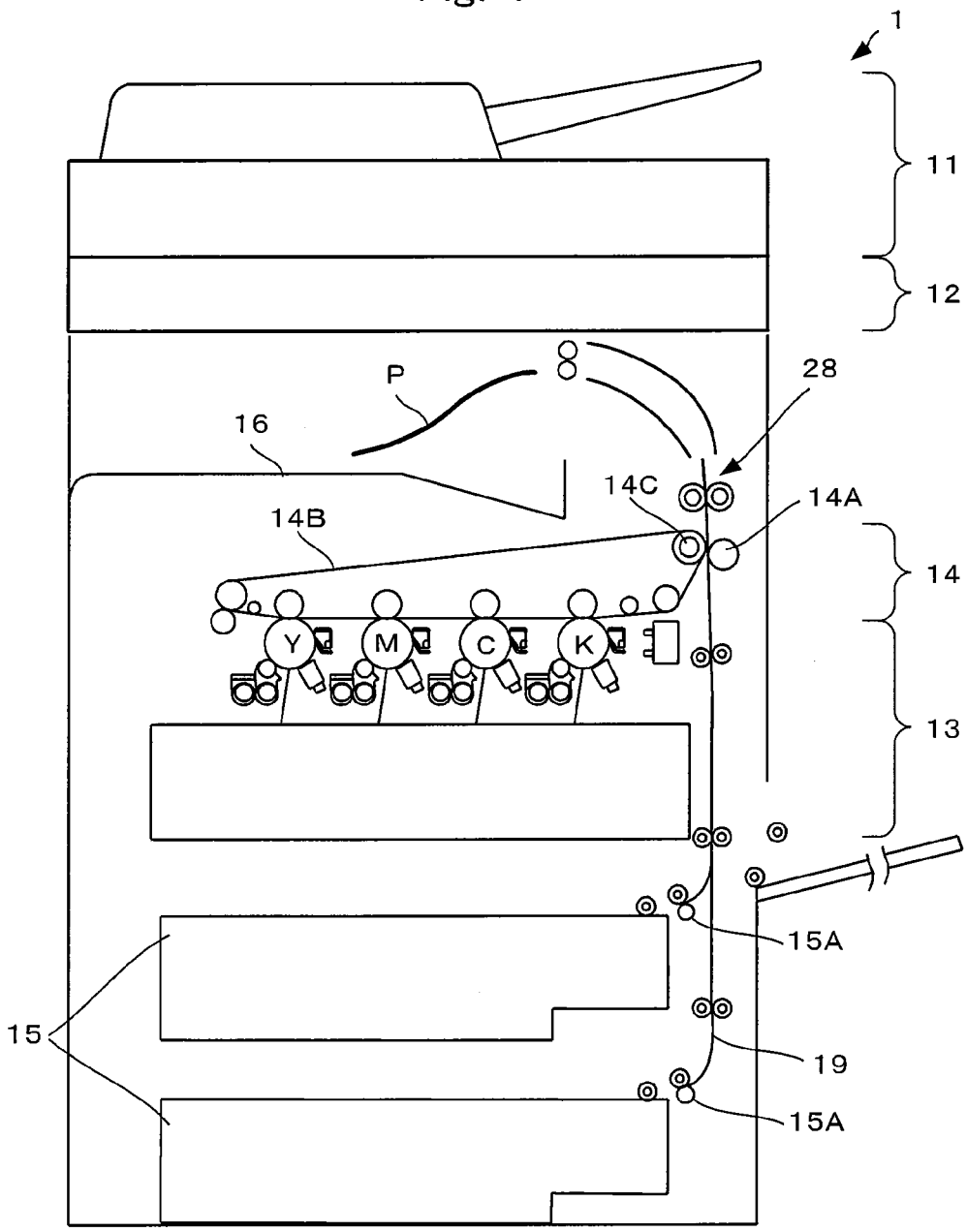
FIG. 1 is a drawing showing a configuration of an image forming apparatus.

Throughout this description, the embodiments and examples shown should be considered as exemplars, rather than limitations on the apparatus and methods of the present embodiments.

Referring now to the drawings, a transfer device, an image forming apparatus, and an image forming method according to an embodiment of the invention will be described. The image forming apparatus here includes a copying machine, an MFP (Multifunction Peripheral), and a printer.

The transfer device in the embodiment includes a transfer roller configured to transfer a developer image to a recording medium, a first resilient member configured to urge the transfer roller in the direction toward a recording medium carrying path; a pair of transfer roller holding members configured to rotate about a center of rotation; and a carrying guide provided downstream of the transfer roller in the recording medium carrying direction and configured to rotate about the center of rotation and to be urged by a second resilient member toward the transfer roller holding members.

The image forming apparatus in the embodiment includes an electrostatic latent image carrier configured to carry an electrostatic latent image; a developer supply unit configured to supply developer to the electrostatic latent image to form a developer image; a transfer roller configured to transfer the developer image to a recording medium; a first resilient member configured to urge the transfer roller in the direction toward a recording medium carrying path; a pair of transfer roller holding members configured to rotate about a center of rotation; a carrying guide provided downstream of the transfer roller in the recording medium carrying direction and configured to rotate about the center of rotation and be urged in the direction toward the transfer roller holding members by a second resilient member; and a fixing device arranged downstream of the carrying guide in the recording medium carrying direction and configured to heat and pressurize the developer image transferred to the recording medium to fix the same.

FIG. 1 is a drawing showing a configuration of an image forming apparatus 1 in the embodiment. As shown in FIG. 1, the image forming apparatus 1 includes an automatic document feeder 11, an image scanning unit 12, an image forming unit 13, a transfer unit 14, a recording medium carrying mechanism 19, and a paper feeding unit 15.

The image forming apparatus 1 includes the automatic document feeder 11 on a top of a main body so as to be openable and closable. The automatic document feeder 11 is provided with an original document carrying mechanism configured to take original documents one by one from a paper feed tray and carry the same to a paper discharge tray.

The automatic document feeder 11 carries the original documents one by one to an original document scanning unit in the image scanning unit 12 by the original document carrying mechanism. It is also possible to open the automatic document feeder 11 and place the original document on an original document bed of the image scanning unit 12.

The image scanning unit 12 includes a carriage having an exposing lamp configured to expose the original document and a first reflection mirror, a plurality of second reflection mirrors engaged with a main body frame of the image forming apparatus 1, a lens block, and a CCD (Charge Coupled Device) of an image scanning sensor.

The carriage stays standstill at the original document scanning unit, or moves reciprocally under the original document bed, and reflects light of the exposing lamp reflected from the original document to the first reflection mirror. The plurality of second reflection mirrors reflect the reflected light from the first reflection mirror to the lens block. The lens block outputs this reflection light to the CCD. The CCD converts incident light into an electric signal and outputs the same to the image forming unit 13 as an image signal.

The image forming unit 13 includes a laser irradiating unit, a photoconductive drum as the electrostatic latent image carrier and the developer supply unit for each of yellow Y, magenta M, cyan C, and black K.

The laser irradiating unit irradiates laser light to the photoconductive drum on the basis of the image signal, and form the electrostatic latent image on the photoconductive drum. The developer supply unit supplies the developer to the photoconductive drum, and forms the developer image from the electrostatic latent image.

The recording medium carrying mechanism 19 includes a pickup mechanism 15A configured to take recording media one by one at an upstream most position on the side of the paper feeding unit 15.

The pickup mechanism 15A takes the recording media one by one from the paper feeding unit 15 and sends the same to the recording medium carrying mechanism 19. The recording medium carrying mechanism 19 carries the recording media to the transfer unit 14.

The transfer unit 14 includes a transfer belt 14B, a transfer roller 14A, and a fixing device 28. The transfer belt 14B is entrained about an opposing roller 14C opposing the transfer roller 14A. The transfer belt 14B as an image carrier receives the developer image on the photoconductive drum transferred thereto and carries the same. The transfer roller 14A transfers the developer image on the transfer belt 14B to the recording medium carried thereto by applying voltage. The fixing device 28 heats and pressurizes the developer image and fixes the same to the recording media.

In another embodiment of the image forming apparatus 1, the developer image is directly transferred from the photoconductive drum to the recording medium. In this case, the transfer roller 14A is arranged so as to oppose the photoconductive drum.

A recording medium P discharged from a paper discharging port is stacked on a paper discharge tray 16, which is a carrying unit for carrying the recording medium.

Figure 2:
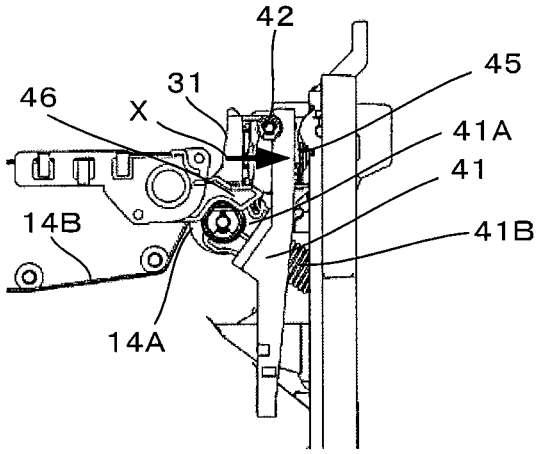
FIG. 2 is a side view of a transfer device in the vicinity of a transfer belt.

FIG. 2 is a side view of the transfer device in the vicinity of the transfer roller 14A. As shown in FIG. 2, the transfer device includes the transfer roller 14A configured to transfer the developer image to the recording medium by applying at least one of voltage and pressure, a first resilient member 41B configured to urge the transfer roller 14A in the direction toward the recording medium carrying path, a pair of sliding members 41A configured to support both ends of the transfer roller 14A independently from each other, a pair of transfer roller holding members 41 configured to support the pair of sliding members 41A so as to be capable of sliding independently and rotate about a center of rotation 42 independently from each other, and a carrying guide 31 configured to rotate about the center of rotation 42, be urged in the direction toward the transfer roller holding members 41 by the second resilient member, and restricted from rotating by the sliding members 41A.

The image forming apparatus 1 includes the carrying guide 31 downstream of the transfer roller 14A in the recording medium carrying direction. The image forming apparatus 1 includes the carrying guide 31 on the side of the transfer roller 14A of the recording medium carrying path. The image forming apparatus 1 includes the carrying guide 31 so as to oppose one of the opposing roller 14C and the photoconductive drum.

The carrying guide 31 is urged by a second resilient member 45 in the direction away from the recording medium carrying path. The carrying guide 31 is urged in the direction by the second resilient member 45 in the direction coming into abutment with the sliding members 41A. Therefore, the carrying guide 31 moves so as to follow the movement of the sliding members 41A.

The sliding members 41A slide in the vertical direction with respect to the urging direction of the first resilient member 41B.

The image forming apparatus 1 includes a positioning member 46 on the side of the opposing roller 14C. The transfer roller 14A is positioned by being in abutment with the positioning member 46. When the transfer roller 14A is positioned, the sliding members 41A are positioned. When the sliding members 41A are positioned, the carrying guide 31 which comes into abutment with the sliding members 41A, and is displaced in conjunction therewith is also positioned.

Here, the transfer roller 14A and the carrying guide 31 rotate about the common center of rotation 42.

Therefore, when the transfer roller 14A is positioned, the carrying guide 31 is positioned while maintaining a relative position with respect to the transfer roller 14A.

Figure 3:
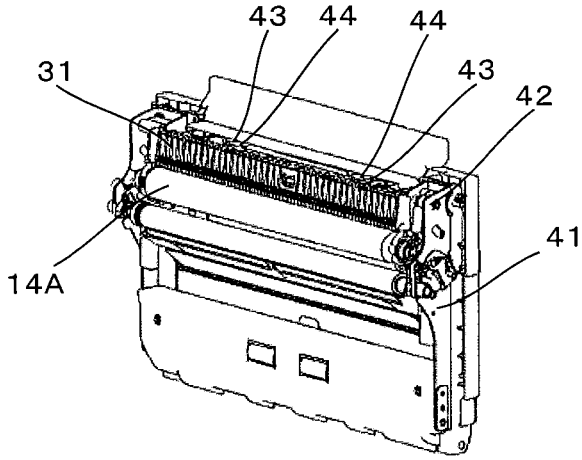
FIG. 3 is a perspective view of a front appearance of the transfer device.
Figure 4:
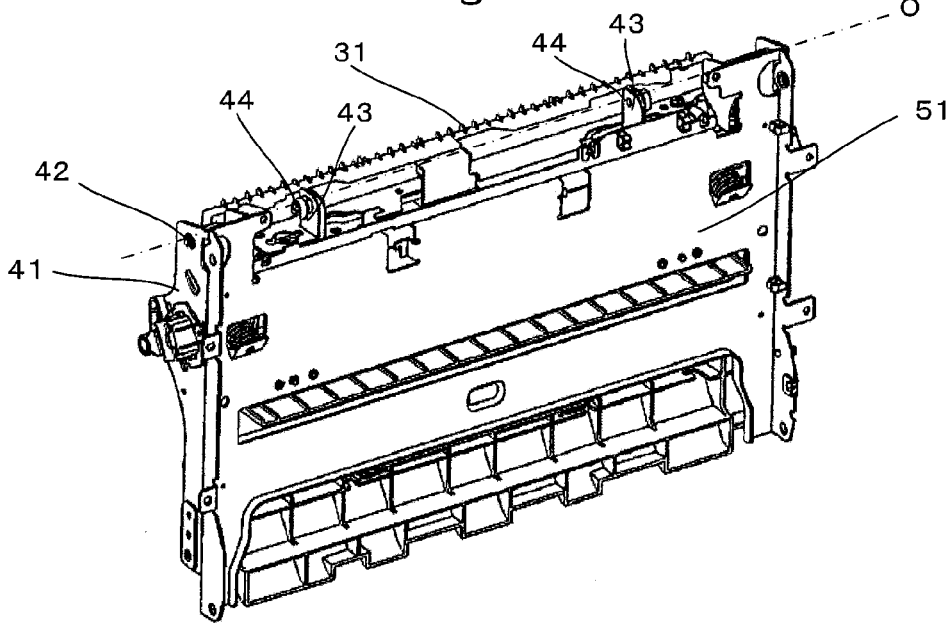
FIG. 4 is a perspective view of a back appearance of the transfer device.
Figure 5:
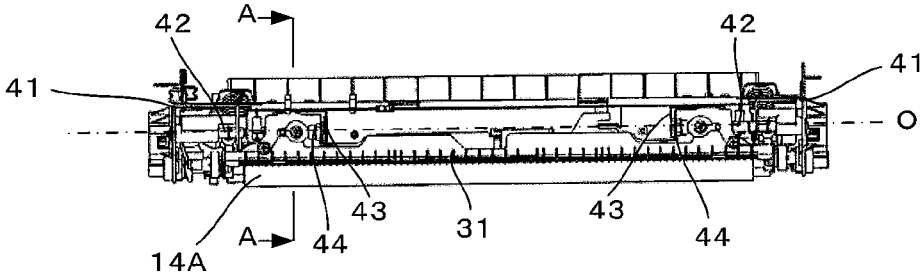
FIG. 5 is a plan view of the transfer device.
Figure 6:
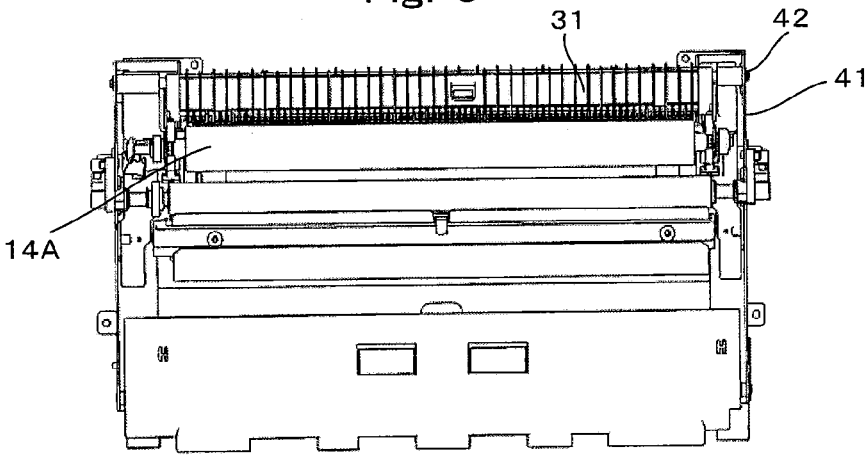
FIG. 6 is a back view of the transfer device.
Figure 7:
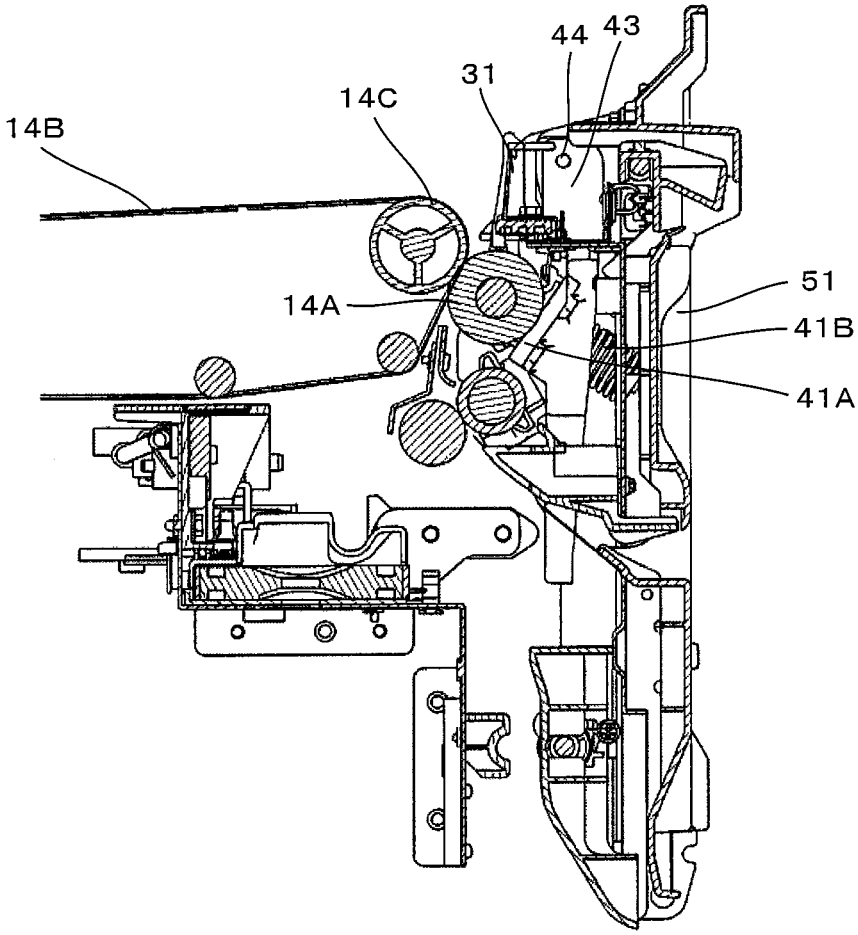
FIG. 7 is a cross-sectional view of the transfer device taken along a line A-A in FIG. 5.

FIG. 3 is a perspective view of a front appearance of the transfer device. FIG. 4 is a perspective view of aback appearance of the transfer device. FIG. 5 is a plan view of the transfer device. FIG. 6 is a back view of the transfer device. FIG. 7 is a cross-sectional view of the transfer device taken along a line A-A in FIG. 5.

As shown in FIG. 3 to FIG. 7, the transfer device includes the transfer roller 14A provided on the transfer roller holding members 41 so as to rotate about the center of rotation 42.

The transfer device includes carrying guide mounting portions 43, and also includes the carrying guide 31 at locking portions 44 having an axis of rotation O which is the same as the center of rotation 42 of the carrying guide mounting portions 43 so as to be rotatable.

The transfer device includes a frame 51, and the frame 51 includes the transfer roller holding members 41 and the carrying guide mounting portions 43.

Figure 8:
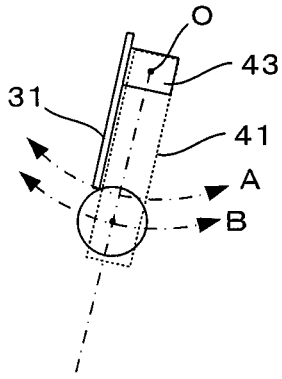
FIG. 8 is a drawing schematically showing a rotating state of a transfer roller and a carrying guide.

FIG. 8 is a drawing schematically showing a rotating state of the transfer roller 14A and the carrying guide 31. As shown in FIG. 8, the transfer roller 14A and the carrying guide 31 both rotate about the common axis of rotation O. The carrying guide 31 rotates in the direction indicated by an arrow A, and the transfer roller 14A rotates in the direction indicated by an arrow B. Therefore, the relative position between the transfer roller 14A and the carrying guide 31 does not vary due to the rotation of the transfer roller 13A.

Therefore, no gap is generated between the transfer roller 14A and the carrying guide 31, so that paper jam does not occur.

Figure 9:
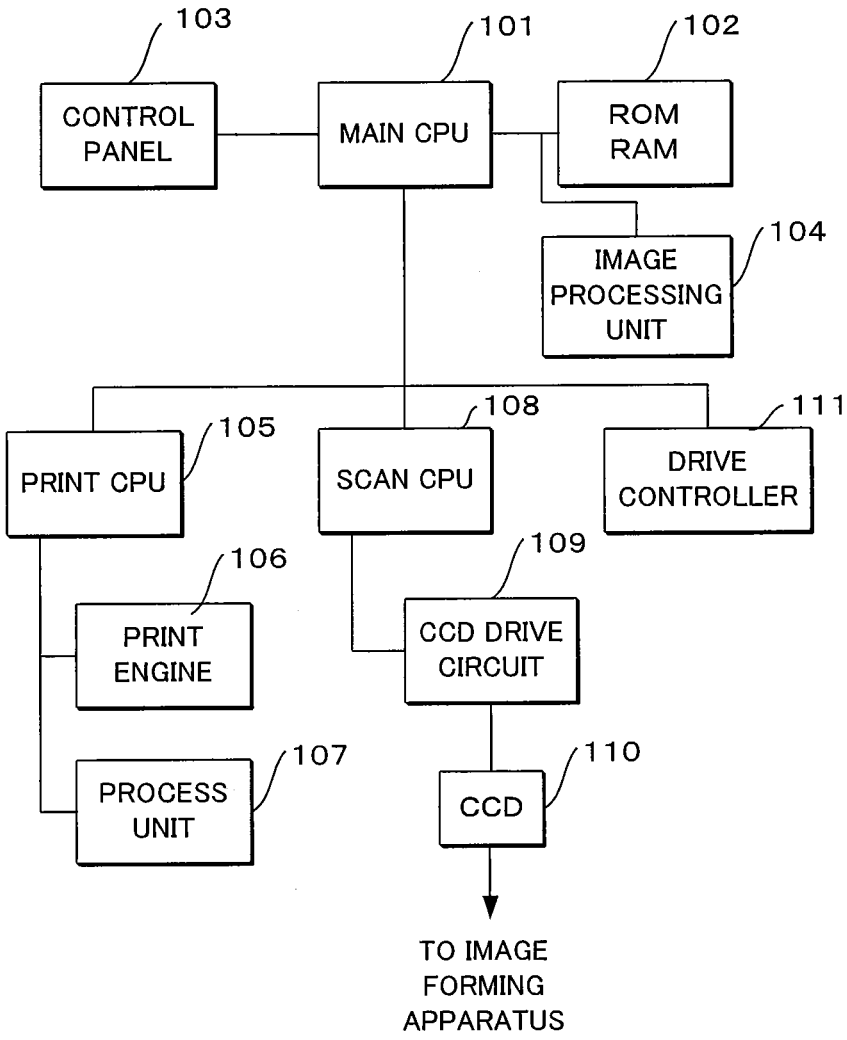
FIG. 9 is a block diagram showing a configuration of the image forming apparatus.

FIG. 9 is a block diagram showing a configuration of the image forming apparatus 1. As shown in FIG. 9, the image forming apparatus 1 includes a main CPU 101 as a control unit, a control panel 103 as a display input device, a ROM and RAM 102 as a storage device, and an image processing unit 104 configured to perform image processing.

The main CPU 101 is connected to and controls a print CPU 105, a scan CPU 108, and a drive controller 111 of the image forming apparatus 1.

The print CPU 105 is connected to and controls a print engine 106 which performs image formation, and a process unit 107 including the transfer device.

The scan CPU 108 controls a CCD drive circuit 109 which drives a CCD 110. An output of the CCD 110 is supplied to the image forming unit.

The drive controller 111 controls the recording medium carrying mechanism 19.

As described thus far, the transfer device in the embodiment includes the transfer roller 14A, the first resilient member 41B configured to urge the transfer roller 14A in the direction toward the recording medium carrying path, the pair of sliding members 41A configured to support the both ends of the transfer roller 14A independently from each other, and the pair of transfer roller holding members 41 configured to support the pair of sliding members 41A so as to be capable of sliding independently and rotate about the center of rotation 42 independently from each other, and the carrying guide 31 configured to rotate about the center of rotation 42, be urged in the direction toward the transfer roller holding members 41 by the second resilient member, and be restricted from rotating by the sliding members 41A.

Therefore, the positioning of the transfer roller and the carrying guide with high degree of accuracy is advantageously achieved without increasing load application to the transfer roller 14A and without causing the paper jam.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A transfer device comprising:

a transfer roller configured to transfer a developer image to a recording medium;

a first resilient member configured to urge the transfer roller in a direction toward a recording medium carrying path;

a pair of transfer roller holding members configured to rotate about a center of rotation;

a carrying guide provided downstream of the transfer roller in the recording medium carrying direction, the carrying guide configured to rotate about the center of rotation and be urged by a second resilient member toward the transfer roller holding members; and a pair of sliding members provided on the transfer roller holding members, the pair of sliding members configured to support both ends of the transfer roller independently from each other, slide relative to the transfer roller holding members, and restrict the rotation of the carrying guide.

2. The device according to claim 1, wherein the pair of transfer roller holding members rotate about the center of rotation independently from each other.

3. The device according to claim 1, wherein the transfer roller transfers the developer image to the recording medium by applying at least one of voltage and pressure thereto.

4. The device according to claim 3, wherein the transfer roller is positioned to oppose an image carrier.

5. The device according to claim 4, wherein the image carrier is a transfer belt.

6. The device according to claim 5, wherein the carrying guide rotates in conjunction with the rotation of the transfer roller.

7. An image forming apparatus comprising:

an electrostatic latent image carrier configured to carry an electrostatic latent image;

a developer supply unit configured to supply developer to the electrostatic latent image and form a developer image;

a transfer roller configured to transfer the developer image to a recording medium;

a first resilient member configured to urge the transfer roller in a direction toward a recording medium carrying path;

a pair of transfer roller holding members configured to rotate about a center of rotation;

a carrying guide provided downstream of the transfer roller in the recording medium carrying direction, the carrying guide configured to rotate about the center of rotation and be urged by a second resilient member toward the transfer roller holding members; and a pair of sliding members provided on the transfer roller holding members, the pair of sliding members configured to support both ends of the transfer roller independently from each other, slide relative to the transfer roller holding members, and restrict the rotation of the carrying guide.

8. The apparatus according to claim 7, wherein the pair of transfer roller holding members rotate about the center of rotation independently from each other.

9. The apparatus according to claim 7, wherein the transfer roller transfers the developer image to the recording medium by applying at least one of voltage and pressure thereto.

10. The apparatus according to claim 9, wherein the transfer roller is positioned so as to oppose the electrostatic latent image carrier.

11. The apparatus according to claim 10, wherein the electrostatic latent image carrier is a transfer belt.

12. The apparatus according to claim 11, wherein the carrying guide rotates in conjunction with the rotation of the transfer roller.

13. An image forming method of an image forming apparatus:

having a transfer roller configured to transfer a developer image to a recording medium, transfer roller holding members configured to rotate about a center of rotation, and sliding members provided on the transfer roller holding members, the pair of sliding members configured to slide relative to the transfer roller holding members and support both ends of the transfer roller independently from each other, said method comprising:

urging the transfer roller toward a recording medium carrying path to rotate the transfer roller about the center of rotation and cause the sliding members to slide relative to the transfer roller holding members;

urging a carrying guide provided downstream of the transfer roller in the recording medium carrying direction toward the transfer roller holding members to rotate the carrying guide about the center of rotation until the carrying guide rotation is restricted by the sliding members;

positioning the carrying guide by positioning the transfer roller;

transferring the developer image to the recording medium by the transfer roller; and carrying the recording medium along the carrying guide.

14. The method according to claim 13, wherein:

the pair of transfer roller holding members are configured to rotate about the center of rotation independently from each other.

15. The method according to claim 13, wherein:

the developer image is transferred to the recording medium by applying at least one of voltage and pressure thereto.

16. The method according to claim 15, wherein:

the transfer roller is positioned to oppose an image carrier.

17. The method according to claim 16, wherein:

the carrying guide is rotated in a first rotational direction in conjunction with the rotation of the transfer roller in a second rotational direction that is opposite the first rotational direction.

18. The device according to claim 1, wherein the first resilient member is configured to urge the transfer roller to rotate in a first rotational direction about the center of rotation, and the second resilient member is configured to urge the carrying guide in a second rotational direction opposite the first rotational direction.

19. The apparatus according to claim 7, wherein the first resilient member is configured to urge the transfer roller to rotate in a first rotational direction about the center of rotation, and the second resilient member is configured to urge the carrying guide in a second rotational direction opposite the first rotational direction.

* * * * *